US007314194B2

(12) United States Patent
Monosoff

(10) Patent No.: US 7,314,194 B2
(45) Date of Patent: Jan. 1, 2008

(54) TOILET PAPER ROLL LOCKING MECHANISM

(76) Inventor: Tamara A. Monosoff, 125 Glover La., Walnut Creek, CA (US) 94596

( * ) Notice: Subject to any disclaimer, the term of this patent is extended or adjusted under 35 U.S.C. 154(b) by 213 days.

(21) Appl. No.: 10/385,732

(22) Filed: Mar. 12, 2003

(65) Prior Publication Data

US 2004/0178293 A1 Sep. 16, 2004

(51) Int. Cl.
*B65H 16/06* (2006.01)

(52) U.S. Cl. ..... 242/422.6; 242/598

(58) Field of Classification Search ..... 242/422.5, 242/422.6, 590, 598, 599.4, 172
See application file for complete search history.

(56) References Cited

U.S. PATENT DOCUMENTS 449,467 A * 3/1891 Davenny ..... 206/54
934,743 A 9/1909 Mitchem
2,527,842 A 10/1950 Mullaney
3,918,661 A 11/1975 Kishi et al.
3,949,947 A 4/1976 Youngquist et al.
4,285,474 A 8/1981 Perez
4,771,966 A 9/1988 Anderson
5,340,047 A 8/1994 Heller
5,367,752 A 11/1994 Petty
6,138,874 A 10/2000 Audrey
6,216,920 B1 * 4/2001 Baggett ..... 222/192
6,308,910 B1 10/2001 Booth
6,398,151 B1 6/2002 Tam
6,824,031 B2 * 11/2004 McKenzie ..... 224/666

* cited by examiner

*Primary Examiner*—John Q. Nguyen
(74) *Attorney, Agent, or Firm*—West & Associates, A PC; Stuart J. West; Charlotte Rodeen-Dickert

(57) ABSTRACT

A device for controlling the unraveling of a toilet paper roll having a hollow core. The device includes an elongated body sized to extend through the hollow core and to permit rotation of the toilet paper roll relative to a holder. A first end portion and a second end portion of the elongated body is accessible at the hollow core. A lead or strap connects to the first end portion of the elongated body, extends around and applies pressure to the toilet paper roll, and connects to the second end portion of the elongated body.

24 Claims, 1 Drawing Sheet

TOILET PAPER ROLL LOCKING MECHANISM

BACKGROUND OF THE INVENTION

The present invention relates to a novel and useful device for controlling the unraveling of a toilet paper roll.

Toilet paper is mounted in many cases to a holder which permits the toilet paper core to rotate when sheets of toilet paper are removed from the roll for use. In most cases such a mounting system is adequate to mete out toilet paper as needed.

However, pets such as cats, young children, and the like have a tendency to unravel or unroll toilet paper unnecessarily. Such unraveled paper must be discarded since it is often contaminated by contact with the floor or other items.

In the past, systems have been proposed to control the unraveling of rolls of material. For example, U.S. Pat. Nos. 4,285,474 and 6,398,151 describe toilet tissue stabilizing devices using spring-like mechanisms to contact the outer surface of the toilet paper roll. The springs prevent free rotation of the roll by this endeavor.

U.S. Pat. Nos. 3,918,661 and 4,771,966 describe paper roll holders in which a roller is used to contact the outer surface of the roll to affect the rotation of the roll about a spindle.

U.S. Pat. Nos. 5,367,752, 6,138,874, and 6,216,920 show mechanical clips and tensioners which are intended to control the unrolling of a roll of paper.

U.S. Pat. Nos. 934,743 and 2,527,842 describe wall holding devices in which a band of material is extended over the outer surface of a roll of material to a certain degree. The bands are intended to prevent the unraveling of the roll material.

U.S. Pat. No. 6,308,910 shows a paper dispensing apparatus in which an elastic member is extended through the tubular holder of a paper roll and is subsequently clipped around the roll to support the same.

U.S. Pat. Nos. 449,467, 3,949,947, and 5,340,047 illustrate clasps using tethers that extend through the core of a roll and are extended around the periphery of the roll to hold the same for controlled dispensing of the paper on the roll.

A device for controlling the unraveling of a toilet paper roll which is reliable and simple to employ would be a notable advance in the field of convenience items.

BRIEF SUMMARY OF THE INVENTION

In accordance with the present invention a novel and useful device for controlling the unraveling of a toilet paper roll is herein provided.

The device of the present invention utilizes an elongated body which is sized to extend at least partially through the hollow core of a toilet paper roll and is sized to permit rotation of the toilet paper roll relative to the toilet paper holder, which also passes through the core of the paper. The elongated body includes a first end portion and a second end portion, each of which are accessible at opposite ends of the core of the toilet paper roll.

A lead or line is also employed in the present invention. The lead connects to the first end portion of the elongated body and is capable of extending over the periphery of the toilet paper roll. Means is provided for removably connecting the lead to the second end portion of the elongated body such that frictional engagement of the lead on the outer surface of toilet paper roll controls the unraveling of the same. The lead may take the form of an elastic member and may be flattened into a band.

In certain cases, the elongated body may take the form of a cylindrical member such that the means for removably connecting the lead to the second end portion of the elongated body includes the provision of an element which is connected to a bitter end of the lead. The element connected to a bitter end of the lead would mate with the second end portion of the elongated body. In one aspect of the invention, the elongated body may include a hollow second end portion and the element connected to a bitter end of the lead would take the form of a plug which fits into and is frictionally held to the hollow portion of the elongated body.

It may be apparent that a novel and useful device for controlling the unraveling of a toilet paper roll has been hereinabove described.

It is therefore an object of the present invention to provide a device for controlling the unraveling of a toilet paper roll which is adaptable for use in a conventional system for supporting a toilet paper roll in a bathroom.

Another object of the present invention is to provide a device for controlling the unraveling of a toilet paper roll which is inexpensive and easy to manufacture.

A further object of the present invention is to provide a device for controlling the unraveling of a toilet paper roll which is not easily disabled by a child or a pet.

Yet another object of the present invention is to provide a device for controlling the unraveling of a toilet paper roll which does not interfere with the conventional rotatable support provided by a toilet paper holder.

The invention possess other objects and advantages especially as concerns particular characteristics and features thereof which will become apparent as the specification continues.

Figure 1:
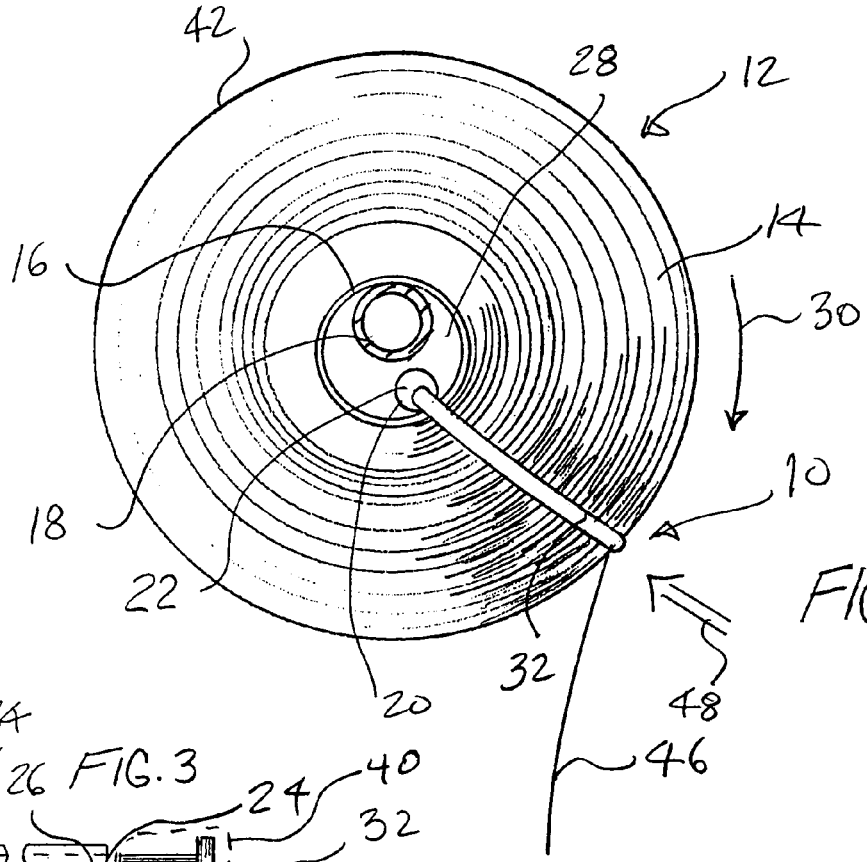
FIG. 1 is a side elevational view of the device in use with a toilet paper roll with a portion of the toilet paper holder shown in section.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the prior delineated drawings.

The preferred embodiment of the invention is shown in the drawings as a whole and is represented by reference character 10. Device 10 is intended to be used with a toilet paper roll 12 which is generally formed as a cylindrical object. Roll 12 includes a multiplicity of layers 14 of toilet paper sheeting which generally spirals from a core 16 that is composed of any rigid or semi rigid material, such as cardboard, plastic, and the like. Core 16 is held in place by a tube or spindle 18 which is mounted to a surface such as a wall, or otherwise supported for use. Typically, toilet paper roll 12 is made available in a bathroom. The support for tube or spindle 18 is of a conventional configuration (not shown).

Device 10 includes as one of its elements an elongated body 20 which may include a closed first end portion 22 and an open second end portion 24. Elongated body 20 may also be formed with a hollow interior portion 26 as depicted in FIG. 1, elongated body 20 lies within the chamber 28 formed by core 16 of toilet paper roll 12. Needless to say, spindle 18 also shares chamber 28 with elongated body 20. Elongated body 20 is sized not to interfere with the relative rotation between core 16 and spindle 18. The rotation of toilet paper roll 12 is indicated by directional arrow 30 in FIG. 1.

Figure 3:
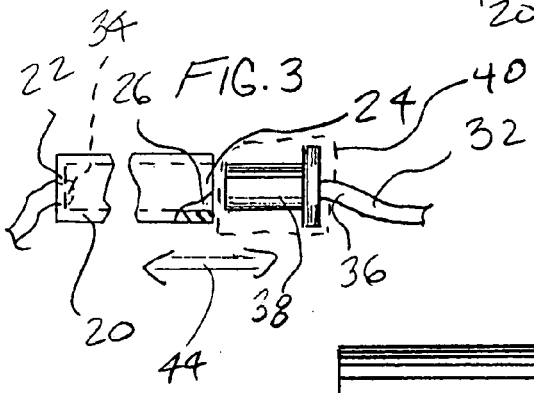
FIG. 3 is a broken, front elevational view of the elongated body and connecting plug used with a preferred embodiment of the invention.
Figure 2:
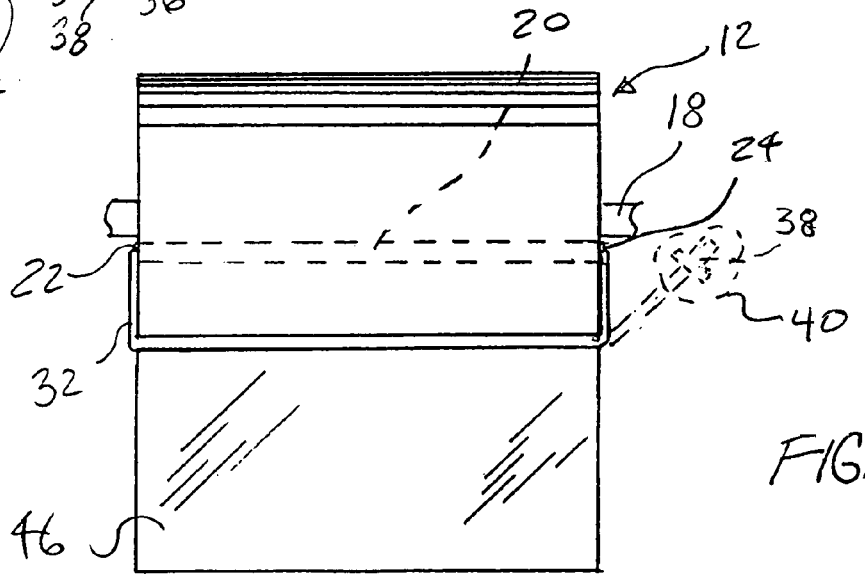
FIG. 2 is a front elevational view of the device of the present invention in use with a toilet paper roll depicting the disconnection of the device in phantom.

Device 10 also is provided with a lead or band 32 which may be constructed of an elastic material. Band 32 connects to first end portion 22 of elongated body 20 by any suitable means such as glue, fasteners, and the like. As depicted in FIG. 3, band 32 is passed through a slot in end 22 and provided with a terminal knot 34. The bitter end 36 of band 32 fixes to an element 38 which is in the form of a plug. Plug 38 is capable of snugly fitting within the open end 24 of elongated body 20 for frictional engagement therewith. Such an arrangement serves as means 40 for removably connecting lead 32 to second end portion 24 of elongated body 20. As depicted in FIGS. 1 and 2, band 32 is capable of extending around and exerting pressure on the outer surface 42 of toilet paper roll 12.

In operation, the user mounts toilet paper roll 12 on spindle 18 in a conventional manner. Elongated member 20 is then extended through core 16 of toilet paper roll to allow accessibility of ends 22 and 24 of elongated member at the extremities of chamber 28 formed by core 16. Band 32 is then drawn around toilet paper roll outer surface 42 and means 40 is employed to removably connect band 32 to elongated member second end portion 24. Specifically, element 38 is plugged into hollow chamber 26 of elongated body 20 and held thereto by friction. Directional arrow 44, FIG. 3 indicates the movement of element 38 relative to elongated body 20. At this point, band 32 is sized to provide a pressure or force on the outer surface 42 of toilet paper roll 12 which would inhibit the removal of toilet paper indicated by sheet 46, FIGS. 1 and 2. Directional arrow 48 shows the force applied to outer surface 42 of toilet paper roll 12, in this regard. When sheet 46 is to be extended further from toilet paper roll 12 for use, element 38 is removed from elongated body 20 and released. Elongated body 20 maintains device 10 in a convenient position such that band 32 may be again configured as shown in FIGS. 1 and 2 when the paper roll is no longer being used.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for controlling the unraveling of toilet paper roll having a hollow core rotatably supported by a toilet paper holder, comprising:

an elongated body, said elongated body sized to extend at least partially through the hollow core and being sized to permit rotation of the toilet paper roll relative to the toilet paper holder; said elongated body including a first end portion and a second end portion;

a lead, said lead connected to said first end portion of said elongated body; and means for removably connecting said lead to said second end portion of said elongated body; said means permitting extension of said lead about the toilet paper roll and the frictional engagement of said lead on the toilet paper roll.

2. The device of claim 1 in which said lead comprises an elastic member.

3. The device of claim 2 in which said elastic member comprises an elongated band.

4. The device of claim 1 in which said elongated body comprises a cylindrical member.

5. The device of claim 1 in which said means for removably connecting said lead to said second end portion of said elongated body comprises said lead including an engageable end and an element connected thereto, said element mating with said second end portion of said elongated body.

6. The device of claim 5 in which said means of removably connecting said lead to said second end portion of said elongated body further comprises means for frictionally engaging said element to said second end portion of said elongated body.

7. The device of claim 5 in which said lead comprises an elastic member.

8. The device of claim 7 in which said elastic member comprises an elongated band.

9. The device of claim 5 in which said elongated body comprises a cylindrical member.

10. The device of claim 9 in which said means for removably connecting said lead to said second end portion of said elongated body further comprises means for frictionally engaging said element to said second end portion of said elongated body.

11. A device for controlling the unraveling of toilet paper roll having a hollow core rotatably supported by a toilet paper holder, comprising:

an elongated body, said elongated body sized to extend at least partially through the hollow core and being sized to permit rotation of the toilet paper roll relative to the toilet paper holder, said elongated body including a first end portion and a second end portion;

a lead, said lead connected to said first end portion of said elongated body; and means for removably connecting said lead to said second end portion of said elongated body; said means permitting extension of said lead about the toilet paper roll and the frictional engagement of said lead on the toilet paper roll;

wherein the frictional engagement of said lead on the toilet paper roll prevents the toilet paper roll from rotation and prevents sheets of toilet paper from being extended from said toilet paper roll.

12. The device of claim 11 in which said lead comprises an elastic member.

13. The device of claim 12 in which said elastic member comprises an elongated band.

14. The device of claim 11 in which said elongated body comprises a cylindrical member.

15. The device of claim 11 in which said means for removably connecting said lead to said second end portion of said elongated body comprises said lead including an engageable end and an element connected thereto, said element mating with said second end portion of said elongated body.

16. The device of claim 15 in which said means of removably connecting said lead to said second end portion of said elongated body further comprises means for frictionally engaging said element to said second end portion of said elongated body.

17. The device of claim 15 in which said lead comprises an elastic member.

18. The device of claim 17 in which said elastic member comprises an elongated band.

19. The device of claim 15 in which said elongated body comprises a cylindrical member.

20. The device of claim 19 in which said means for removably connecting said lead to said second end portion of said elongated body further comprises means for frictionally engaging said element to said second end portion of said elongated body.

21. A device for controlling the unraveling of a toilet paper comprising:

an elongated body, said elongated body sized to extend at least the length of the toilet paper roll, said elongated body including a first end portion and a second end portion; and a securing member, said securing member being substantially parallel to said elongated body and having a first end and a second end;

wherein said securing member selectively and frictionally engages said toilet paper roll.

22. The device of claim 21, wherein said securing member is operationally coupled with at least one of said first end portion and said second end; and wherein at least one end of said securing member is removably coupled with at least one of said first end portion and said second end portion.

23. The device of claim 21, wherein said securing member is operationally coupled with said elongated body.

24. The device of claim 23, further comprising:

at least one extension member having a proximal and distal end, said proximal end configured to removably couple with said toilet paper holder;

wherein said distal end of said at least one extension member is rotatably coupled with said elongated body.

* * * * *